US008646113B2

(12) United States Patent
Clement et al.

(10) Patent No.: US 8,646,113 B2
(45) Date of Patent: Feb. 11, 2014

(54) SPORTS GLOVE HAVING IMPROVED WRIST STRAP

(75) Inventors: Ken Clement, Milton (CA); Craig Clement, Kingston (CA); John David Zikakis, Mount Albert (CA)

(73) Assignee: Hayabusa Fightwear Inc., Kingston, Ontario (CA)

( * ) Notice: Subject to any disclaimer, the term of this patent is extended or adjusted under 35 U.S.C. 154(b) by 229 days.

(21) Appl. No.: 13/031,964

(22) Filed: Feb. 22, 2011

(65) Prior Publication Data

US 2012/0210485 A1 Aug. 23, 2012

(51) Int. Cl.
*A41D 13/08* (2006.01)

(52) U.S. Cl.
USPC ..... 2/18; 2/161.1

(58) Field of Classification Search
USPC ..... 2/20, 159, 161.1, 161.4, 162, 161.7, 2/161.8, 160, 161.5, 170
See application file for complete search history.

(56) References Cited

U.S. PATENT DOCUMENTS

| | | | | | |
|---|---|---|---|---|---|
| 4,287,610 | A | * | 9/1981 | Rhee | 2/18 |
| 4,958,384 | A | * | 9/1990 | McCrane | 2/161.6 |
| 4,984,300 | A | | 1/1991 | Cho | |
| D320,872 | S | * | 10/1991 | McCrane | D29/113 |
| 5,083,314 | A | | 1/1992 | Andujar | |
| 5,146,624 | A | * | 9/1992 | Bruckner | 2/18 |
| 5,197,149 | A | * | 3/1993 | Overton | 2/162 |
| 5,295,269 | A | | 3/1994 | Ballard | |
| D362,927 | S | * | 10/1995 | McCrane | D29/117.1 |
| 5,513,391 | A | | 5/1996 | Garneau et al. | |
| 5,706,521 | A | | 1/1998 | Haney | |
| 5,802,614 | A | | 9/1998 | Melone | |
| 6,119,267 | A | | 9/2000 | Pozzi | |
| 6,178,553 | B1 | | 1/2001 | Bolton | |
| 6,553,576 | B1 | * | 4/2003 | Knapp | 2/161.6 |
| 6,604,244 | B1 | * | 8/2003 | Leach | 2/161.6 |
| 2009/0320178 | A1 | | 12/2009 | Faulconer | |
| 2013/0000006 | A1 | * | 1/2013 | Norton et al. | 2/16 |

FOREIGN PATENT DOCUMENTS

WO WO 2011/006053 A1 1/2011

OTHER PUBLICATIONS

International Searching Authority, "International Search Report and Written Opinion", for application PCT/CA2011/050107, applicant Hayabusa Fightwear Inc. et al, Feb. 22, 2011.

* cited by examiner

*Primary Examiner* — Khoa Huynh
*Assistant Examiner* — Anna Kinsaul
(74) *Attorney, Agent, or Firm* — Brion Raffoul

(57) ABSTRACT

The present invention provides a protective sports glove worn. The glove may be used by athletes during training or in a combative event requiring striking to protect against injury and increase performance, including, but not limited to, total force transference, grip strength, striking force and speed, muscular endurance, time to contraction, etc. These gloves have an adjustable dual strapping wrist tie system to secure the gloves to the contour of the hands and ensure they remain tight and fixed. The dual strapping system seeks to provide increased wrist and hand rigidity that mirrors a tightness of hand wrap bandages for maximal bone and tendon support of the hands and wrists. This system increases the transfer of force to the point of impact.

4 Claims, 12 Drawing Sheets

SPORTS GLOVE HAVING IMPROVED WRIST STRAP

FIELD OF THE INVENTION

The present invention relates to a combat sports glove designed for improved fit and function.

BACKGROUND OF THE INVENTION

Combat athletes, especially mixed martial arts (MMA) practitioners, use gloves that generally are cumbersome, thick, non form-fitting and lack in adequate wrist and hand support. These conventional gloves quickly, and with repetitive use, lose the ability to maintain proper fit and function. This can lead to a decrease in force transfer and related hand and fist functioning and also can lead to injury. Another shortcoming of these conventional combat gloves is that, when the glove strikes a target or an opponent, the glove can be loose on the hand and the wrist portion of the glove can be unstable. This shortcoming can lead to improper bone alignment and thus an injury can be experienced by the athlete during training or at a competitive event.

Maintaining maximal force transmission in relation to striking force and grip strength are key factors in support performance during stand up or ground combat. Injury prevention is also of great importance to these athletes especially specific to protection related to the hands and fists. In particular, through repeated use and wear, the glove fit may become lose and inadequate to function properly.

SUMMARY OF THE INVENTION

The present invention provides a protective sports glove worn. The glove may be used by athletes during training or in a combative event requiring striking to protect against injury and increase performance, including, but not limited to, total force transference, grip strength, striking force and speed, muscular endurance, time to contraction, etc.

The present invention provides an adjustable dual strapping wrist tie system to secure the glove to the contour of the hand and ensure it remains tight and fixed. The dual strapping system seeks to provide increased wrist and hand rigidity that mirrors a tightness of hand wrap bandages for maximal bone and tendon support of the hands and wrists.

This system also advantageously increases the transfer of force to the point of impact.

In a first aspect, the present invention provides a protective sports glove comprising: a body having: a dorsal portion; a volar portion; a finger portion for fingers; and a wrist portion for a wrist; wherein the finger portion has a first section for enclosing the second, third, fourth and fifth fingers together and a second section for enclosing the thumb; wherein the dorsal portion has a layer of padding extending over a dorsal side of the first and second sections of the finger portion; wherein the wrist portion of the body has a strap closure for adjustably securing the glove to the wrist and is continuous over the dorsal portion and discontinuous over the volar portion, thereby forming a gap on the volar portion and extending distally and having a termination point prior to the finger portion, and the gap has a thumb-side edge and an opposing-side edge; wherein the strap closure has a primary support strap and a secondary support strap, and each strap has a reversible fastening means; wherein the primary support strap is fixed at the thumb-side edge of the gap and arranged to pass across the gap and through a slot on the opposing-side edge of the gap for fastening to the dorsal side of the wrist portion, the dorsal side of the wrist portion is adapted for reversible fastening; and wherein the secondary support strap is fixed at the opposing-side of the gap and arranged to pass across the gap in a direction opposite that of the support strap for fastening to the dorsal side of the wrist portion overtop the fastened support strap.

In a second aspect, the present invention provides a protective sports glove comprising: a body having: a dorsal portion; a volar portion; a finger portion for fingers; and a wrist portion for a wrist; wherein the finger portion has a section for enclosing the fingers, and the region for enclosing the fingers has loops for individually accepting the second, third, forth, and fifth proximal phalanges; wherein the dorsal portion has a layer of padding covering at least the second, third, fourth, and fifth metacarpals and proximal phalanges and associated base knuckles; wherein the wrist portion of the body has a strap closure for adjustably securing the glove to the wrist and is continuous over the dorsal portion and discontinuous over the volar portion, thereby forming a gap on the volar portion and extending distally and having a termination point prior to the finger portion, and the gap has a thumb-side edge and an opposing-side edge; wherein the strap closure has a primary support strap and a secondary support strap, such that each strap has a reversible fastening means; wherein the primary support strap is fixed at the thumb-side edge of the gap and arranged to pass across the gap and through a slot on the opposing-side edge of the gap for fastening to the dorsal side of the wrist portion, the dorsal side of the wrist portion adapted for reversible fastening; and wherein the secondary support strap is fixed at the opposing-side of the gap and arranged to pass across the gap in a direction opposite that of the support strap for fastening to the dorsal side of the wrist portion overtop the fastened support strap.

In a third aspect, the present invention provides a protective sports glove for use by persons engaging in combat sports requiring striking with a closed fist and open hand grabbing, the glove comprising: a body having: a dorsal portion; a volar portion; a finger portion for fingers; and a wrist portion for a wrist; wherein the finger portion comprising has a region for accepting the fingers, wherein such that the region for accepting the fingers comprises loops for individually accepting the first, second, third, forth, and fifth proximal phalanges; wherein the dorsal portion comprising has a first layer of padding covering at least the second, third, fourth, and fifth metacarpals and proximal phalanges and associated base knuckles and a second layer of padding covering the thumb metacarpal and proximal phalange; wherein the wrist portion of the body comprising has a strap closure for adjustably securing the glove to the wrist and is continuous over the dorsal portion and discontinuous over the volar portion, thereby forming a gap on the volar portion and extending distally and having a termination point prior to the finger portion, the gap having a thumb-side edge and an opposing-side edge; wherein the strap closure comprising has a primary support strap and a secondary support strap, and each having strap has a reversible fastening means; wherein the primary support strap being is fixed at the thumb-side edge of the gap and arranged to pass across the gap and through a slot on the opposing-side edge of the gap for fastening to the dorsal side of the wrist portion, the dorsal side of the wrist portion adapted for reversible fastening; and the secondary support strap being is fixed at the opposing-side of the gap and arranged to pass across the gap in a direction opposite that of the support strap for fastening to the dorsal side of the wrist portion overtop the fastened support strap.

In a fourth aspect, the present disclosure provides a protective sports glove comprising: a body having: a dorsal portion; a volar portion; a finger portion for fingers; and a wrist portion for a wrist; wherein the finger portion has a first section for enclosing the second, third, fourth and fifth fingers together and a second section for enclosing the thumb; wherein the dorsal portion has a layer of padding extending over a dorsal side of the first and second sections of the finger portion; wherein the wrist portion of the body has a gap on the volar portion for adjustably securing the glove to accommodate the wrist, and wherein the gap extends distally along the volar portion and has a termination point prior to the finger portion, and the gap has a thumb-side edge and an opposing-side edge; wherein the wrist portion has a primary support strap and a secondary support strap; wherein the primary support strap has a fastening means on both sides and is fixed at the thumb-side edge of the gap and arranged to pass across the gap and through a slot on the opposing-side edge of the gap for fastening to the dorsal side of the wrist portion, the dorsal side of the wrist portion is adapted for fastening; wherein pulling the primary support strap through the slot acts to narrow the gap to tightly conform the wrist portion to the wrist; and wherein the secondary support strap has a fastening means on the side that attaches to the primary support strap on the dorsal side of the wrist portion and is fixed at the opposing-side edge of the gap and arranged to pass across the gap in a direction opposite that of the primary support strap when the primary support strap is fastened for fastening to the dorsal side of the wrist portion overtop of the fastened primary support strap and affixing to the fastened primary support strap.

BRIEF DESCRIPTION OF THE FIGURES

Embodiments of the invention have been chosen for purposes of illustration and description and are not intended to be limiting. Throughout the drawings, like elements are referred to by like numerals.

DETAILED DESCRIPTION

While the various embodiments of the present invention are herein described with specific examples, those examples are not intended to be limiting, and those of skill in the art will appreciate and recognize other embodiments and advantages of the present invention.

It should be noted that commonly accepted anatomical names are used throughout this document to refer to parts of the hand and corresponding parts of the gloves. The term, dorsal, refers to the back or top of the hand. The term, volar, refers to the bottom or palm-side of the hand. The thumb is understood to be considered the first finger, but is commonly referred to herein as the thumb. The remaining fingers, proceeding from the first finger, are referred to herein as the second, third, fourth, and fifth fingers.

Figure 1:
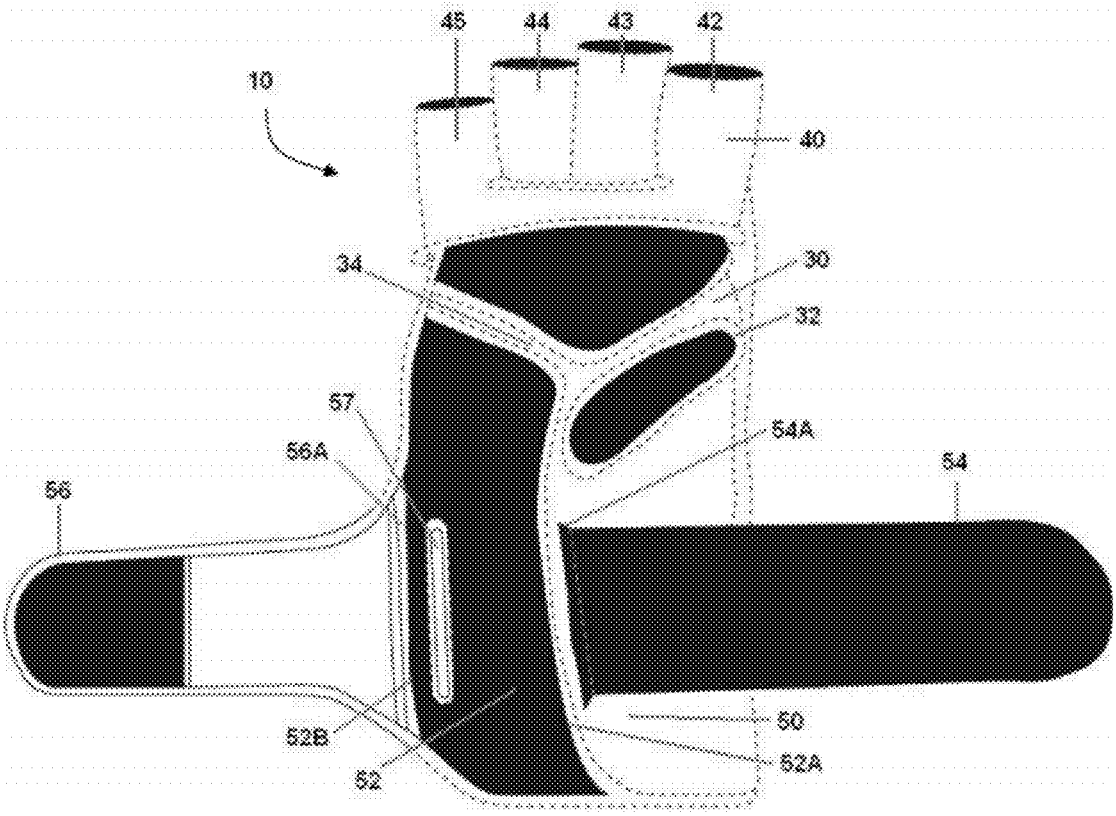
FIG. 1 is a bottom view showing the volar/palm side of a glove showing both straps open according to one embodiment of the present invention.

Referring to FIG. 1, a glove 10 is shown in palmer view. Glove 10 has a dorsal portion (not visible in this view), a volar portion 30, a finger portion 40, and a wrist portion 50. The volar portion 30 contains an elongated thumb slot 32 for allowing thumb movement. Volar portion 30, in combination with the elongated thumb slot 32, forms, in a preferred embodiment, a Y-shaped structure 34.

According to a preferred embodiment, the finger portion 40 is comprised of loops for individually accepting the second 42, third 43, fourth 44, and fifth 45 proximal phalanges. Wrist portion 50 is formed with a gap 52, having a thumb-side edge 52A and an opposing-side edge 52B. A primary support strap 54 is attached to the thumb-side edge 52A at 54A and a secondary support strap 56 is attached to the opposing-side edge 52B at 56A. The opposing-side edge 52B contains a slot 57.

In use, an individual places their hand inside glove 10. The gap 52 allows for the wrist portion 50 and volar portion 30 to open and accommodate the hand, the hand being larger in circumference in some regions than the wrist. The individual's thumb passes through thumb slot 32 and their second, third, fourth, and fifth fingers pass through loops 42, 43, 44, and 45, respectively, of finger portion 40.

Figure 2:
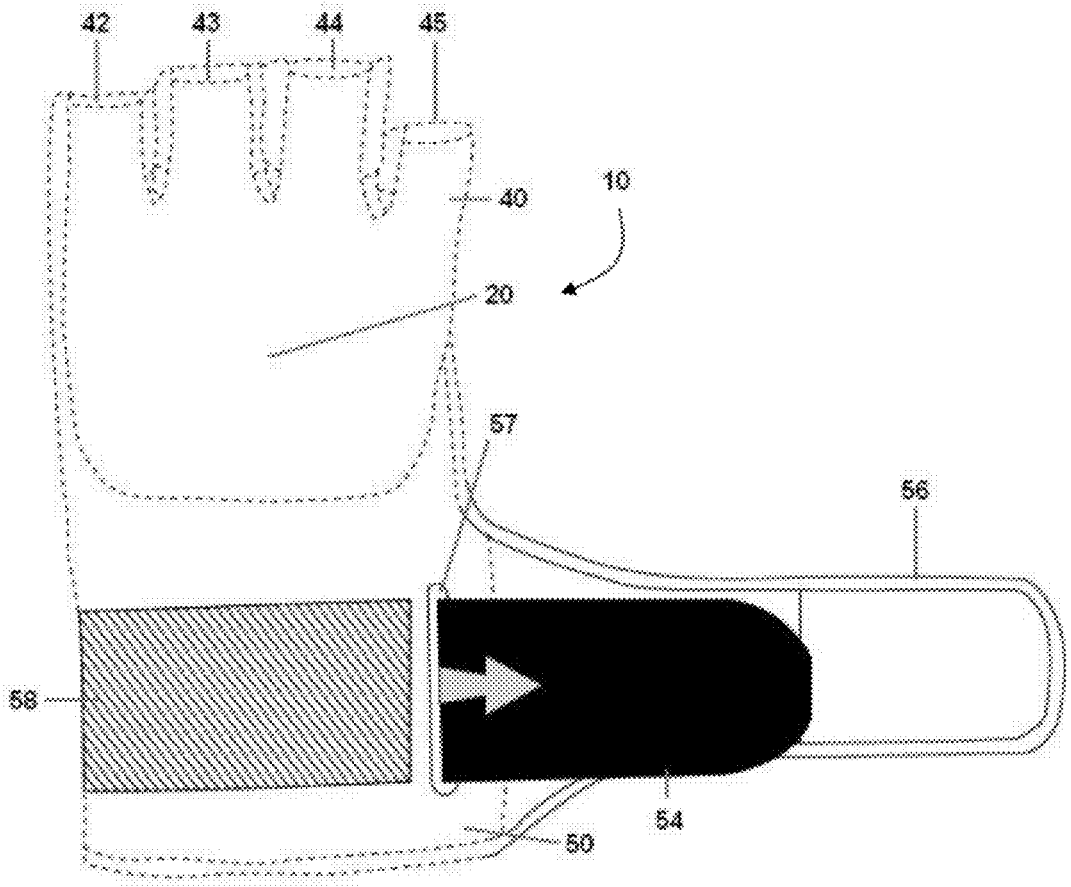
FIG. 2 is a top view of the dorsal/top side of the glove shown in FIG. 1 having the primary strap passed through the slot and in an unsecured or unfastened position.

Next, primary support strap 54 is passed through slot 57 as shown in FIG. 2. FIG. 2 shows the opposite side of the glove 10 shown in FIG. 1 with the primary support strap 54 passed through slot 57 and also showing dorsal portion 20. In some embodiments, dorsal portion 20 contains padding material to protect the dorsal part of the hand and the proximal phalanges portions of the second, third, fourth, and fifth fingers. In use, primary strap 54 is pulled tightly in the direction of the straight arrow shown in FIG. 2. In a preferred embodiment, the primary support strap 54 has an elastic portion, preferably near the thumb-side attachment 54A. As primary support strap 54 is pulled, it narrows or closes the gap 52 and volar Y-shaped structure 34 to tightly conform to the wearer's hand and wrist, thereby producing a tight, supportive fit. The dorsal side of wrist portion 50 includes a region 58 having means to accommodate removable fastening of the strap closure system (shown in crosshatch), in particular the primary support strap 54, which in turn also contains a means to facilitate removable fastening. The means to facilitate removable fastening are preferably hook-and-loop type fastening, such as that made by Velcro®.

Figure 3:
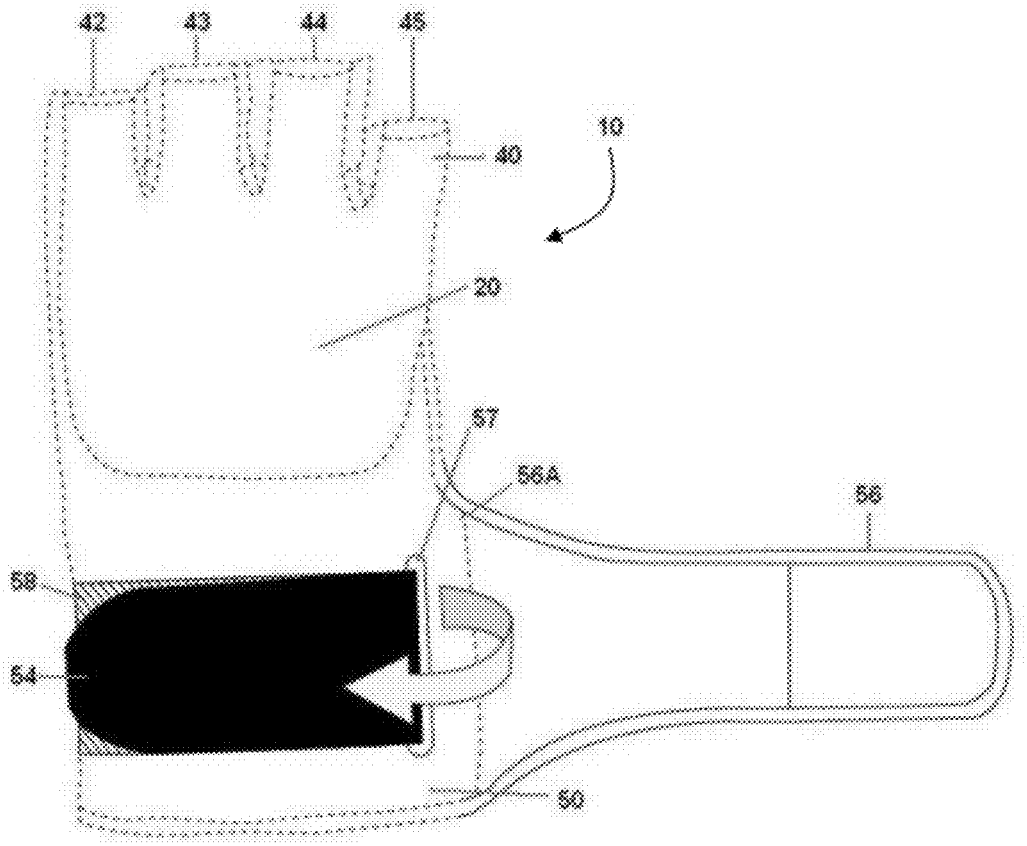
FIG. 3 is a view similar to that shown in FIG. 2 with the glove having the primary strap passed through the slot and in a secured or fastened position.

Now referring to FIG. 3, the primary support strap 54, having been pulled tightly as shown in FIG. 2 is now shown in a fastened position having been pulled in the direction of the straight arrow shown in FIG. 3. The primary support strap 54 is pulled back across over the dorsal side of wrist portion 50 in the opposite direction against slot 57 and securely fastened to region 58.

Figure 4:
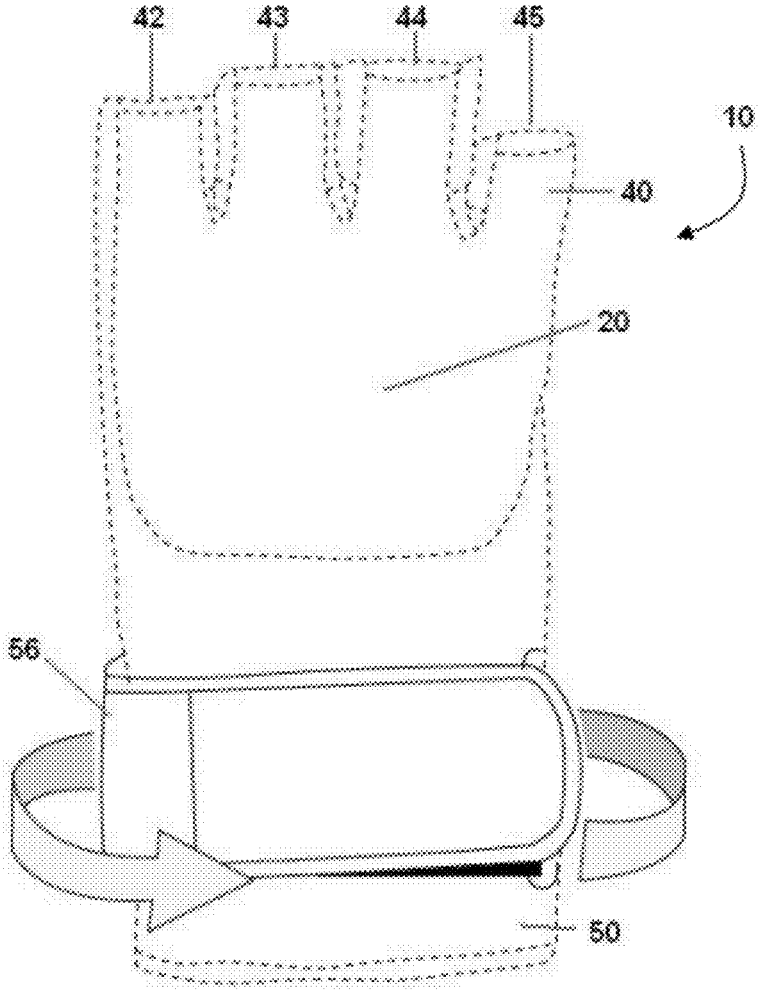
FIG. 4 is a top view of the dorsal side of the glove shown in FIG. 3 showing both straps in a secured or fastened position.

Referring now to FIG. 4, glove 10 is shown in a dorsal view with the dual strap closure system fully closed and secured. To facilitate removable fastening, the secondary support strap 56 has means to facilitate fastening to the primary support strap on the dorsal side of the wrist portion. To secure secondary support strap 56, it is, from the unsecured position (shown in FIGS. 1-3), first pulled tightly in the direction of the arrow shown in FIG. 4 across the volar side of wrist portion 50 (shown in FIG. 1), then around to the dorsal side of wrist portion 50 and then across the dorsal side of wrist portion 50 and fastened overtop of the secured primary support strap 54, which is already secured to region 58.

In an alternative embodiment, the primary support strap 54 has removable fastening means on both of its sides to facilitate fastening to region 58 and to facilitate fastening of the secondary support strap 56. In further aspects of the preferred embodiment, secondary support strap 56 includes at least a portion of a non-stretch material.

Figure 5:
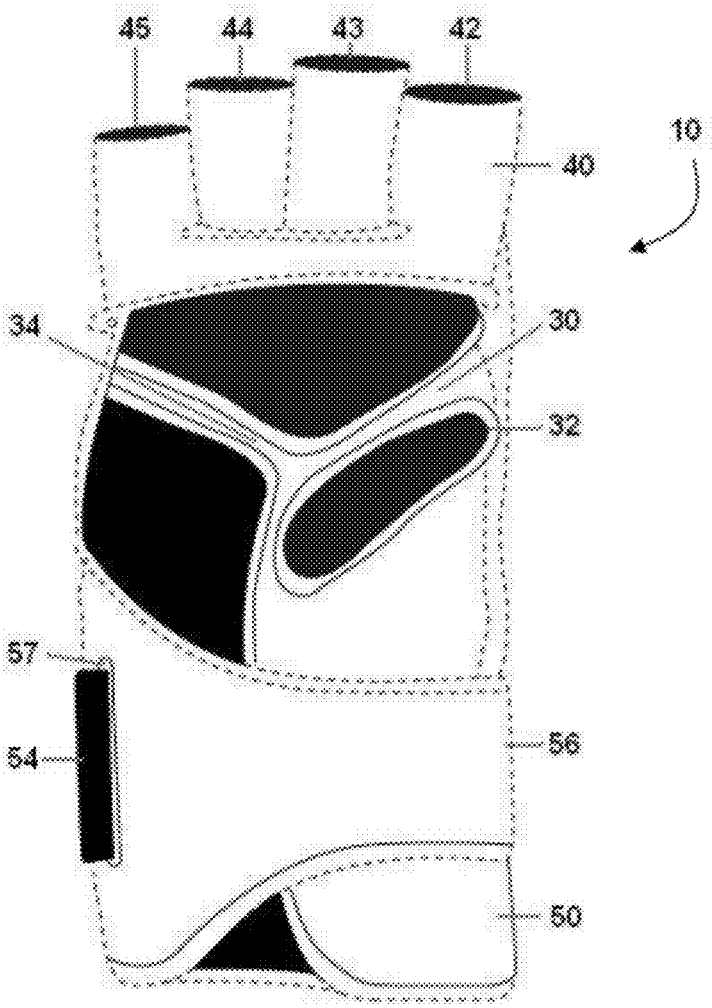
FIG. 5 is a bottom view of the volar side of the glove shown in FIG. 4.

FIG. 5 shows the volar-side view of the glove with the straps fastened.

FIGS. 6 through 10 show the glove 10 in an alternative embodiment but with a corresponding operation of the dual strap system as shown in FIGS. 1 through 5.

Figure 6:
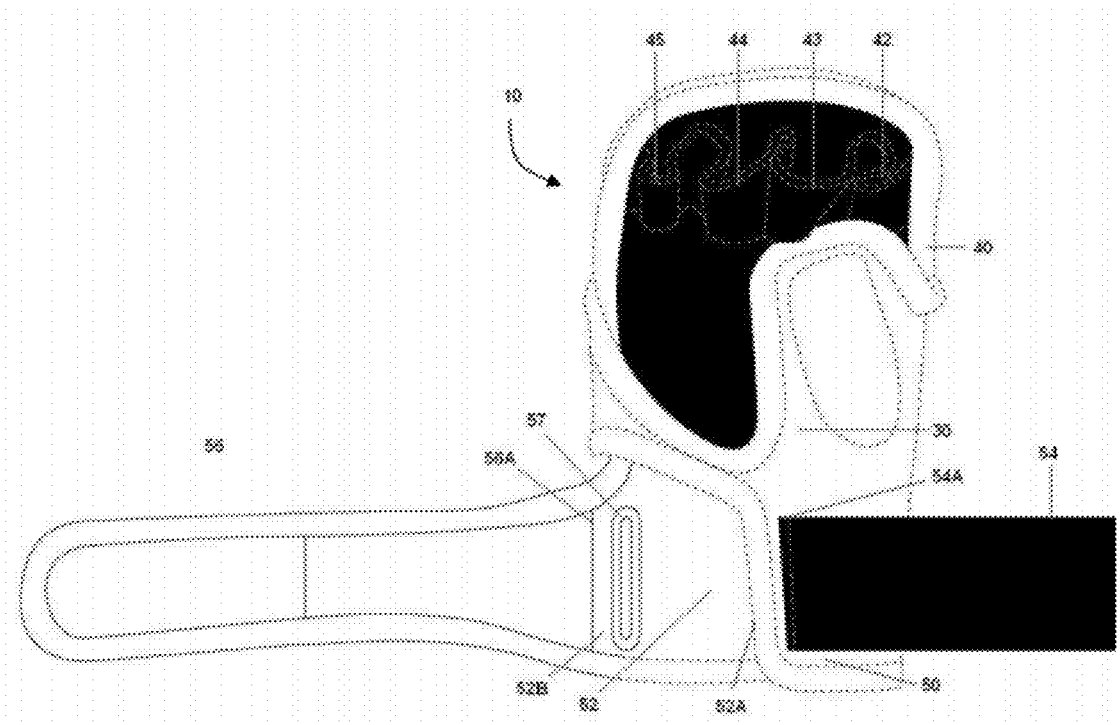
FIG. 6 is a bottom view showing the volar/palm side of a glove according to an alternative embodiment of the present invention showing both straps open.
Figure 7:
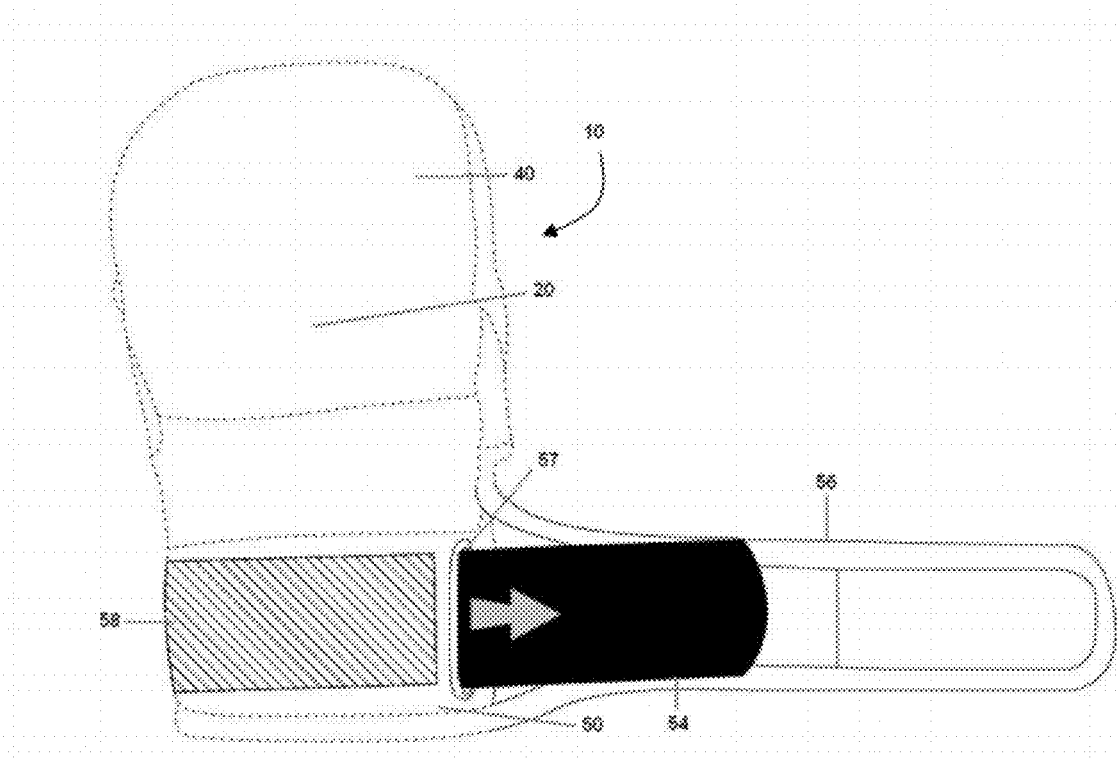
FIG. 7 is a top view of the dorsal/top side of the glove shown in FIG. 6 having the primary strap passed through the slot and in an unsecured or unfastened position.
Figure 8:
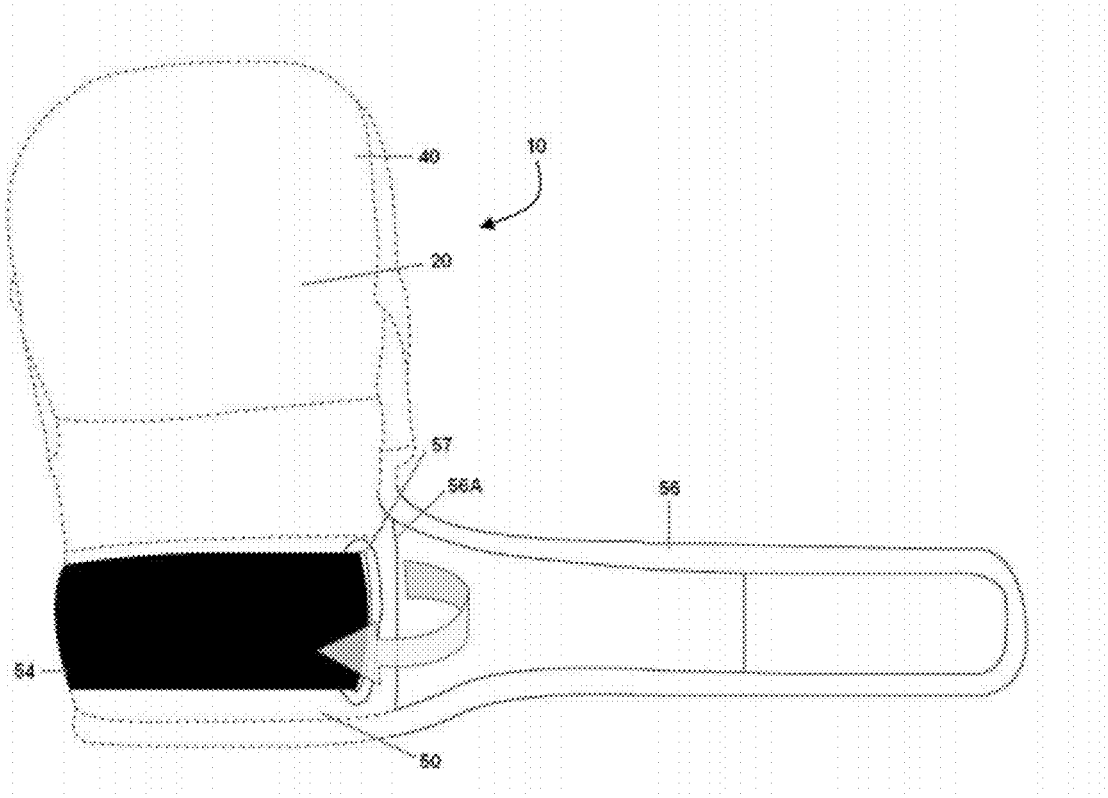
FIG. 8 is a view similar to that shown in FIG. 7 with the glove having the primary strap passed through the slot and in a secured or fastened position.

Referring now to FIG. 6, a glove 10 is shown in palmer view. Glove 10 has a dorsal portion (not visible in this view), a volar portion 30, a finger portion 40, and a wrist portion 50. The finger portion 40 according to this embodiment is comprised of loops for individually accepting the thumb (not visible in the figures), second 42, third 43, fourth 44, and fifth 45 proximal phalanges. Wrist portion 50 is formed with a gap 52, having a thumb-side edge 52A and an opposing-side edge 52B. A primary support strap 54 is attached to the thumb-side edge 52A at 54A and a secondary support strap 56 is attached to the opposing-side edge 52B at 56A. The opposing-side edge 52B contains a slot 57.

For the use of the dual strap system, FIGS. 7 through 10 correspond to FIGS. 2 through 5, respectively. Like parts are identified by the same numerals.

Figure 9:
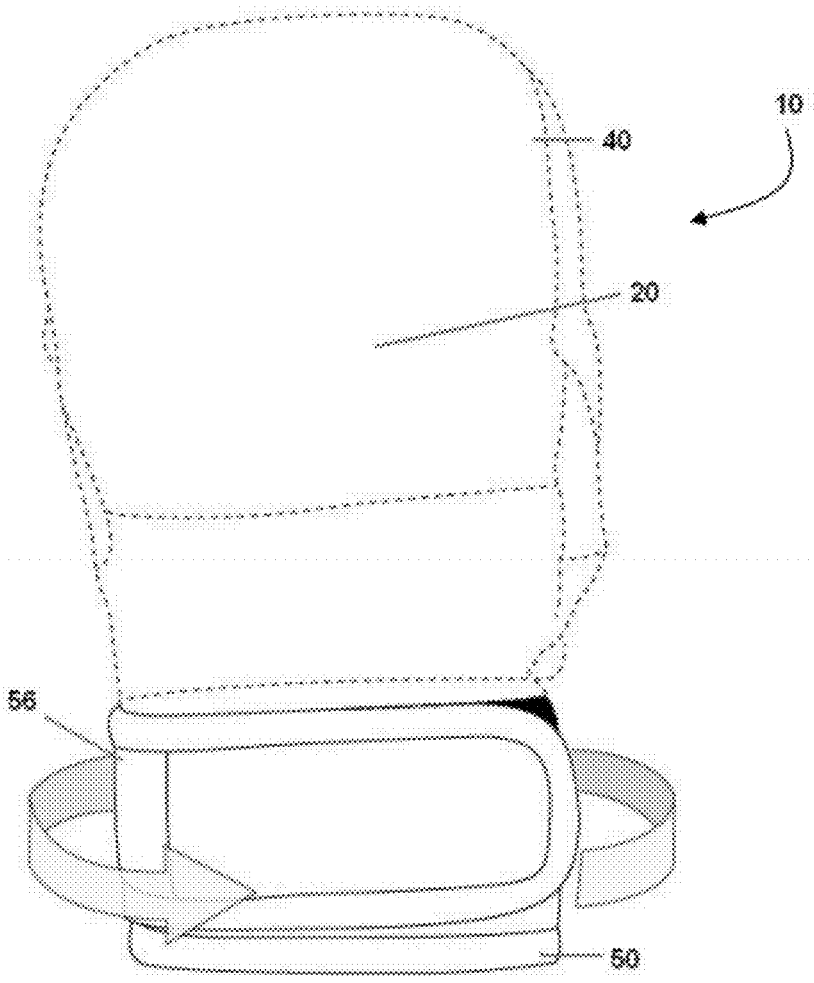
FIG. 9 is a top view of the dorsal side of the glove shown in FIG. 8 showing both straps in a secured or fastened position.
Figure 10:
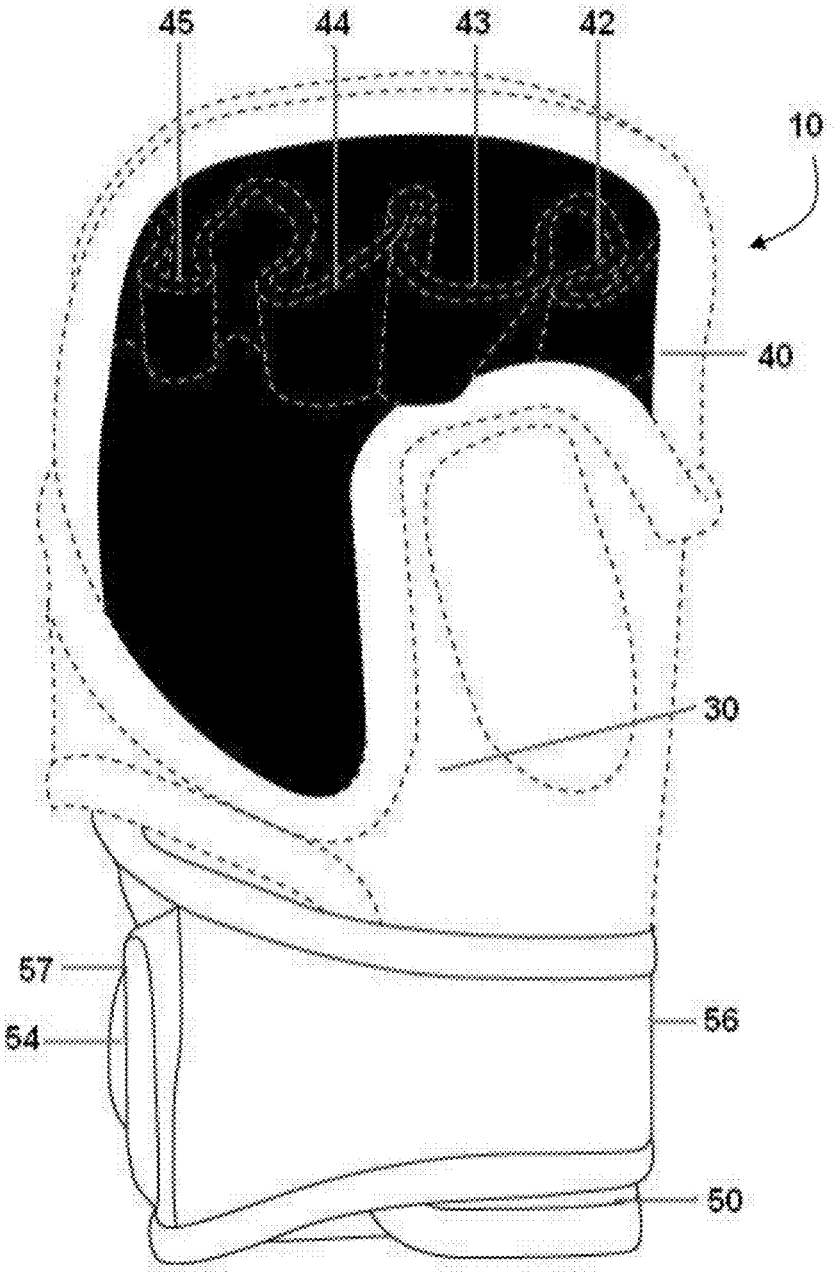
FIG. 10 is a bottom view of the volar side of the glove shown in FIG. 9.
Figure 11:
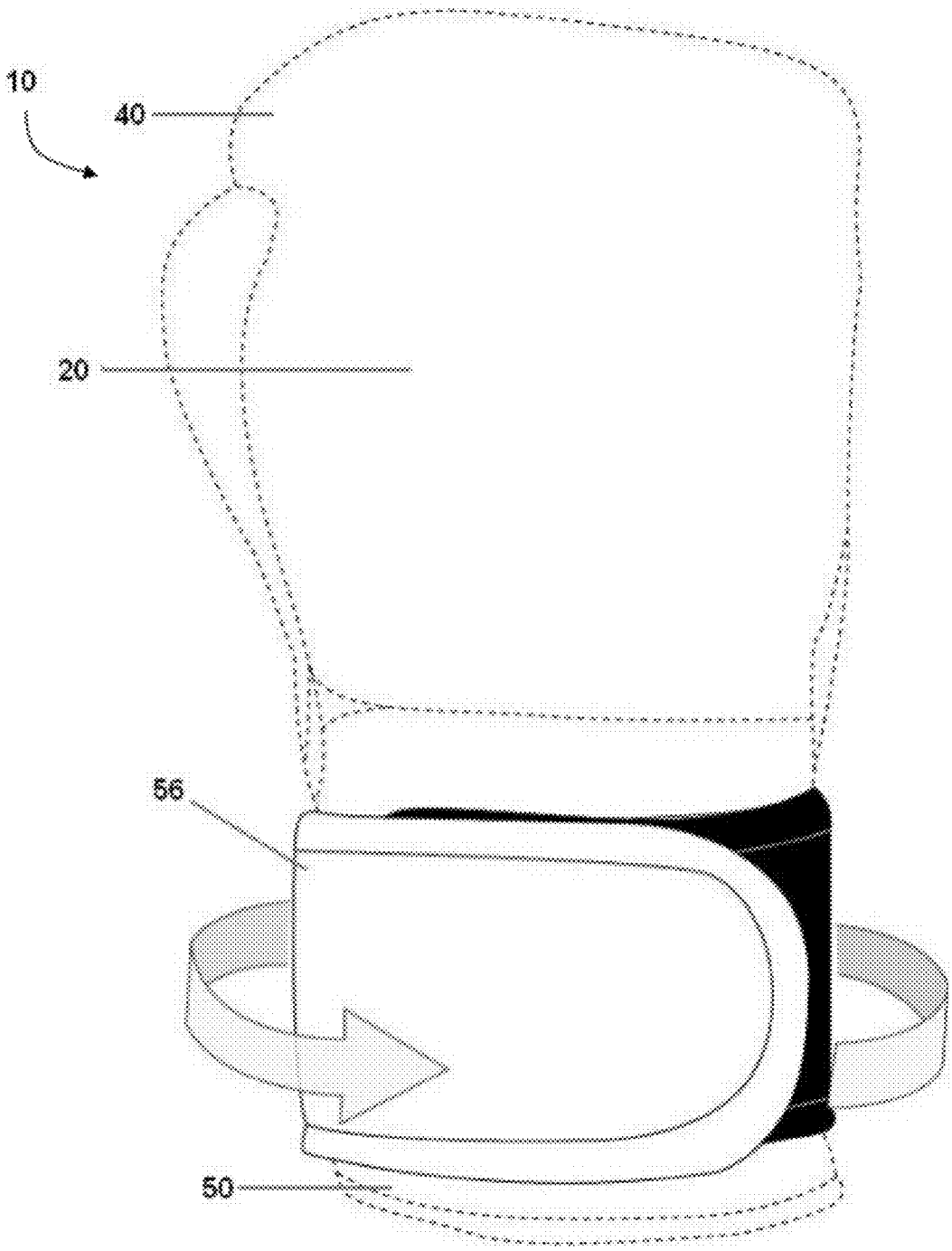
FIG. 11 a top view of the dorsal/top side of a glove showing both straps in a secured or fastened position according to another alternative embodiment of the present invention.
Figure 12:
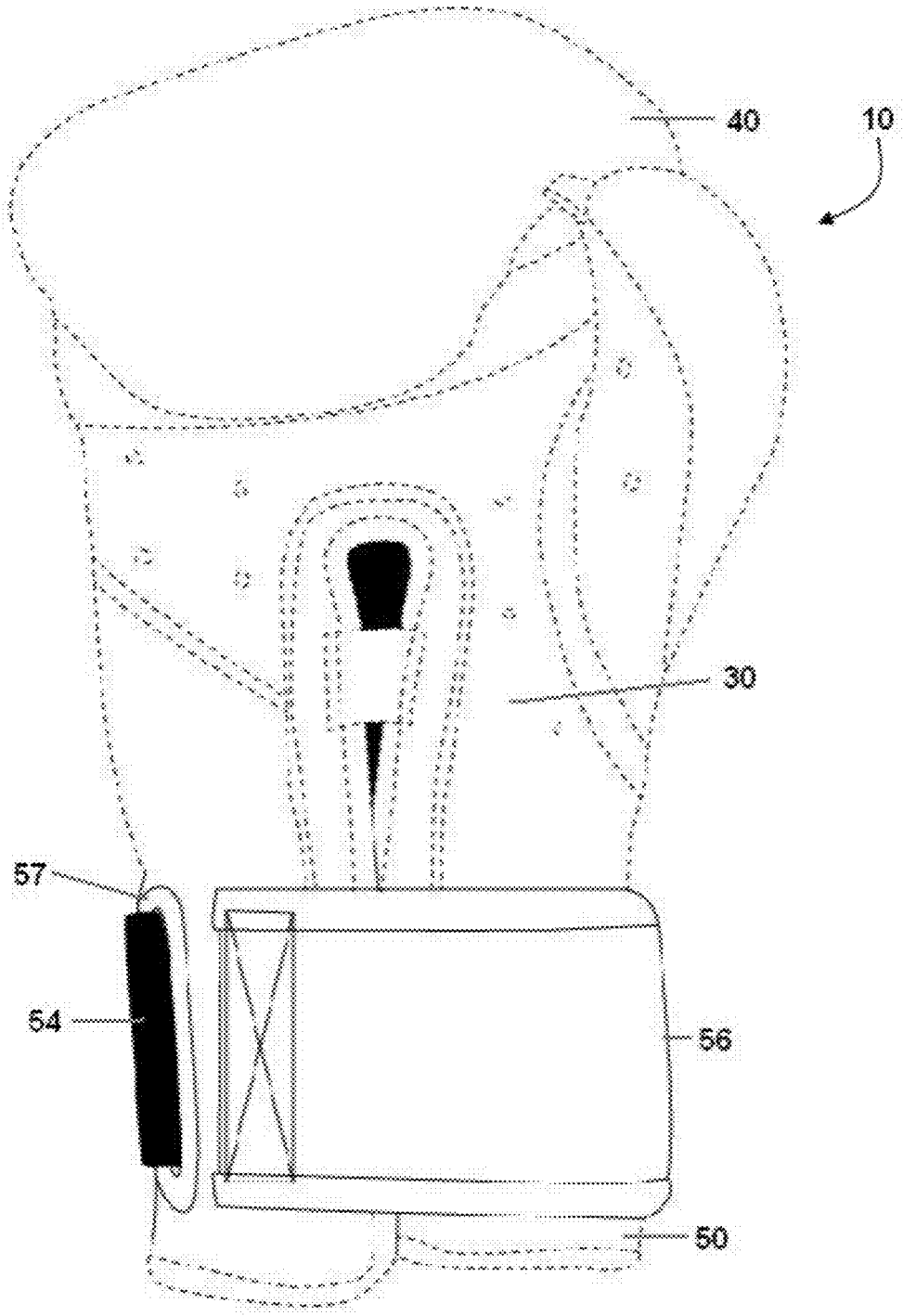
FIG. 12 is a bottom view of the volar side of the glove shown in FIG. 11.

FIGS. 11 and 12 show a glove according to another alternative embodiment of the present invention and correspond to FIGS. 4 and 5 and to FIGS. 9 and 10. Closure of the dual strap system is as previously described. Glove 10 has a dorsal portion 20, a volar portion 30, a finger portion 40, and a wrist portion 50. Finger portion 40 is comprised of two separate compartments; one for receiving the thumb and one for receiving the second, third, fourth, and fifth fingers. FIG. 11 shows the glove 10 in dorsal view with the primary support strap 54 (not shown) already fastened as described in the embodiments above and the secondary support strap 56 being fastened as in FIGS. 4 and 9. FIG. 12 shows glove 10 in palmer view with both straps secured as in FIGS. 5 and 10.

The present invention provides gloves with improved wrist closure for improved fit and function by providing a dual cross directional strap system with the combination of a primary support strap having an elastic, stretchable portion and a non-stretchable secondary support strap. Advantageously, gloves according to the various embodiments of the invention prevent rapid loosening and maintain proper fit and function for longer periods of time than those of the prior art.

Further improvements in fit and function are provided, in certain embodiments of the invention, by inclusion of a volar Y-shaped structure. Here, the glove includes a contouring hand/fist Y-shaped structure to generate a bare-knuckle like contour glove to support maximal force production during striking, while providing a proper fit during open-hand grabbing and repeated transitions between opened and closed hand. This Y-shaped structure is particularly well-suited to mixed martial arts gloves.

The gloves may be made of material commonly used to manufacture combat sport gloves. Such materials include leather or vinyl. For padding, commonly known material may be used such as high-density polyurethane.

The elements of the present invention described herein may be used in a variety of specific glove types. For example the features may be incorporated into gloves commonly worn in specific combat sports such as boxing, kick-boxing, and mixed martial arts, in which each may use gloves of different weight including, but not limited to, 4 oz, 6 oz, 8 oz, 10 oz, 12 oz, 14 oz, 16 oz, 18 oz, and 20 oz.

What is claimed is:

1. A protective sports glove comprising:

a body having:

a finger portion for fingers having a dorsal side and a volar side;

a wrist portion for a wrist having a dorsal side and a volar side;

wherein the finger portion has a first section for enclosing second, third, fourth and fifth fingers together and a second section for enclosing a thumb; where the second section is adjacent to the second finger of the first section;

wherein the dorsal side of the finger portion has a layer of padding extending over the first and second sections of the finger portion;

wherein the volar side of the wrist portion has a gap for adjustably securing the glove to accommodate the wrist, and wherein the gap has a thumb-side edge and an opposing-side edge, wherein the opposing-side edge is adjacent to the fifth finger of the first section of the finger portion, and wherein the gap extends distally in a horizontal direction from a middle region of the volar side of the wrist portion to the opposing-side edge on the volar side of the wrist portion, and the gap terminates in a vertical direction prior to the finger portion;

wherein the wrist portion has a primary support strap and a secondary support strap;

wherein the primary support strap is attached to the thumb-side edge of the gap and is adapted for fastening to the dorsal side of the wrist portion and the primary support strap is constructed and arranged to pass across the gap and through a slot on the volar side adjacent the opposing-side edge of the gap to the dorsal side of the wrist portion for fastening the primary support strap to a complimentary fastening on the dorsal side of the wrist portion;

wherein the primary support strap is constructed and arranged to be pulled through the slot to narrow the gap and to tightly conform the wrist portion to the wrist;

wherein the secondary support strap is attached to the opposing-side edge of the gap; and the secondary support strap is constructed and arranged to pass across the gap in a direction opposite that of the primary support strap;

and wherein the secondary support strap has a fastening means that attaches to a fastened primary support strap, and the secondary support strap is constructed and arranged to fasten to complimentary fastening means on top of the fastened primary support strap on the dorsal side of the wrist portion.

2. The protective sports glove of claim 1, wherein at least one of the primary support strap and the secondary support strap includes a non-stretch material.

3. The protective sports glove of claim 2, wherein the secondary support strap includes a non-stretch material.

4. The protective sports glove of claim 3, wherein the primary support strap includes an elastic portion.

* * * * *